US009302376B2

(12) United States Patent
Agehara et al.

(10) Patent No.: US 9,302,376 B2
(45) Date of Patent: Apr. 5, 2016

(54) ROTARY TOOL

(71) Applicant: MAX CO., LTD., Tokyo (JP)

(72) Inventors: Kigen Agehara, Tokyo (JP); Kazuya Sakamaki, Tokyo (JP); Shinichi Ookubo, Tokyo (JP); Yasunori Takahashi, Tokyo (JP)

(73) Assignee: MAX CO., LTD., Tokyo (JP)

( * ) Notice: Subject to any disclaimer, the term of this patent is extended or adjusted under 35 U.S.C. 154(b) by 704 days.

(21) Appl. No.: 13/664,671

(22) Filed: Oct. 31, 2012

(65) Prior Publication Data

US 2013/0105187 A1 May 2, 2013

(30) Foreign Application Priority Data

Nov. 2, 2011 (JP) ..... 2011-241148

(51) Int. Cl.
*B25F 5/00* (2006.01)
*B25B 21/02* (2006.01)
*B25F 5/02* (2006.01)

(52) U.S. Cl.
CPC . *B25B 21/02* (2013.01); *B25F 5/00* (2013.01); *B25F 5/021* (2013.01)

(58) Field of Classification Search
CPC ..... B25F 5/00; H01H 13/02
USPC ..... 173/1, 2, 20, 170, 171, 217; 200/522, 200/520
See application file for complete search history.

(56) References Cited

U.S. PATENT DOCUMENTS

| | | | | |
|---|---|---|---|---|
| 4,722,252 | A | 2/1988 | Fulcher et al. | |
| 6,062,323 | A | 5/2000 | Pusateri et al. | |
| 6,687,567 | B2 * | 2/2004 | Watanabe | 700/168 |
| 2005/0121209 | A1 * | 6/2005 | Shimizu et al. | 173/217 |
| 2006/0186102 | A1 * | 8/2006 | Inagaki et al. | 219/130.21 |
| 2009/0057122 | A1 * | 3/2009 | Sato | 200/522 |

FOREIGN PATENT DOCUMENTS

| | | | |
|---|---|---|---|
| CN | 1274309 | A | 11/2000 |
| CN | 1494988 | A | 5/2004 |
| CN | 200981216 | Y | 11/2007 |
| CN | 201295891 | Y | 8/2009 |
| JP | H8-336762 | A | 12/1996 |
| JP | 2011-136378 | A | 7/2011 |
| WO | WO-00/05036 | A1 | 2/2000 |

* cited by examiner

*Primary Examiner* — Nathaniel Chukwurah
(74) *Attorney, Agent, or Firm* — Drinker Biddle & Reath LLP

(57) ABSTRACT

A rotary tool (10) having a plurality of switchable modes is provide with a trigger (19) and a switching lever (20) disposed around a grip (13) for selecting a rotational direction of a motor (31). The switching lever (20) is operated between a forward rotation state, a reverse rotation state, and a neutral state. A switching of the modes is executed when the switching lever (20) is positioned in the neutral state and the trigger (19) is pulled.

6 Claims, 11 Drawing Sheets

| No. | 0 | 1 | 2 |
|---|---|---|---|
| ROTATIONAL DIRECTION SIGNAL | FORWARD | NO SIGNAL (NEUTRAL) | REVERSE |

| MODE NAME | STRONG (FOR STEEL) | STRONG (FOR WOOD) | WEAK | RETIGHTENING |
|---|---|---|---|---|
| MODE FLAG | 0 | 1 | 2 | 3 |

ROTARY TOOL

BACKGROUND OF THE INVENTION

1. Field of the Invention

The present invention relates to a mode switchable rotary tool.

2. Related Art

In general, a rotary tool, such as an impact driver, is provided with a switch for switching a rotation mode, so that a rotation mode can be selected and used depending on a kind of screw or a member to be screwed.

A switch for switching the rotation mode is provided on a circuit board in a lower portion of a body grip, as disclosed in Patent Document 1. In order to operate such a switch, since the switch cannot be operated by a hand holding the grip, the switch should be operated with another hand that does not hold the grip.

Patent Document 1: JP-A-2011-136378

However, when a usual impact driver or the like is used, a user holds the member with the hand that does not hold the grip. For this reason, in order to operate the switch by the hand that does not hold the grip, the user should release the holding member. As a result, interruption of the work occurs.

SUMMARY OF THE INVENTION

One or more embodiments of the invention provide a rotary tool capable of switching a mode with a hand holding a grip.

In accordance with embodiments of the invention, a rotary tool having a plurality of switchable modes may include: a motor; a trigger; a power source switch that turns on a power source of the rotary tool when the trigger is pulled to a predetermined position; a rotation control switch which rotates the motor when the trigger is pulled over the predetermined position; and a switching lever disposed around a grip to determine a rotational direction of the motor. The switching lever may be operated between a forward rotation state of forwardly rotating the motor, a reverse rotation state of reversely rotating the motor, and a neutral state which is neither the forward rotation state nor the reverse rotation state. A switching of the modes may be executed when the switching lever is positioned in the neutral state and the trigger is pulled.

DETAILED DESCRIPTION OF THE EMBODIMENTS

An embodiment of the present invention will now be described with reference to the accompanying drawings.

Figure 1:
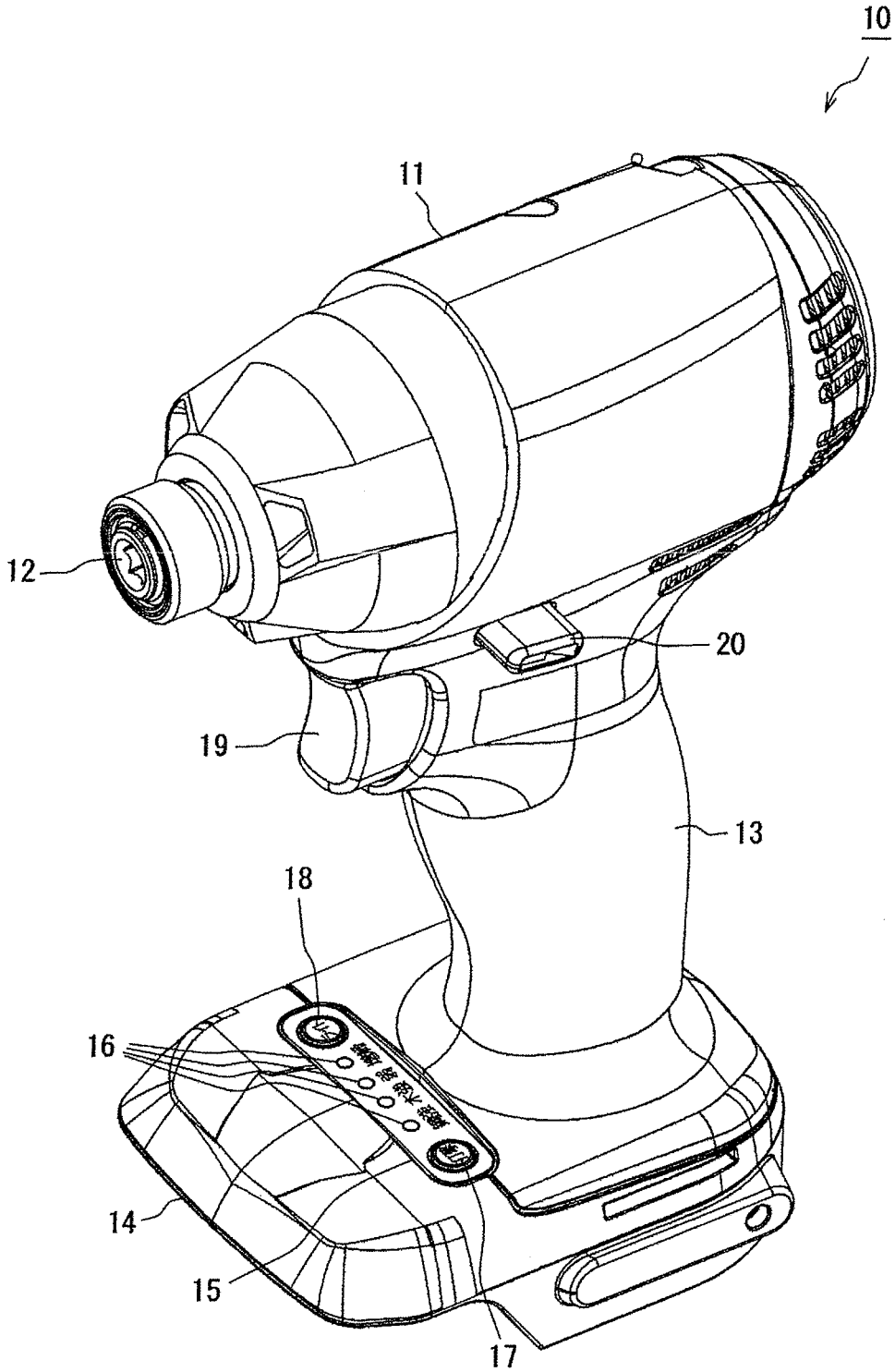
FIG. 1 is a perspective view of a rotary tool.

A rotary tool 10 according to this embodiment is an impact driver equipped with a motor 31, and, as illustrated in FIG. 1, includes a cylindrical output section 11, a grip portion extending from a lower portion of the output section 11 in a direction substantially perpendicular to the output section 11, and a battery pack fitting section 14 installed at a lower portion of the grip portion 13.

<Output Section 11>

The output section 11 houses the motor 31, and includes a spindle, a striking mechanism, and an anvil which are installed in series and coaxially with a rotational shaft of the motor 31. An output shaft 12 provided on a front end portion of the anvil is adapted to be mounted with a driver bit (front end tool). The driver bit is rotated by a driving force of the motor 31 to perform screw fastening.

Figure 3:
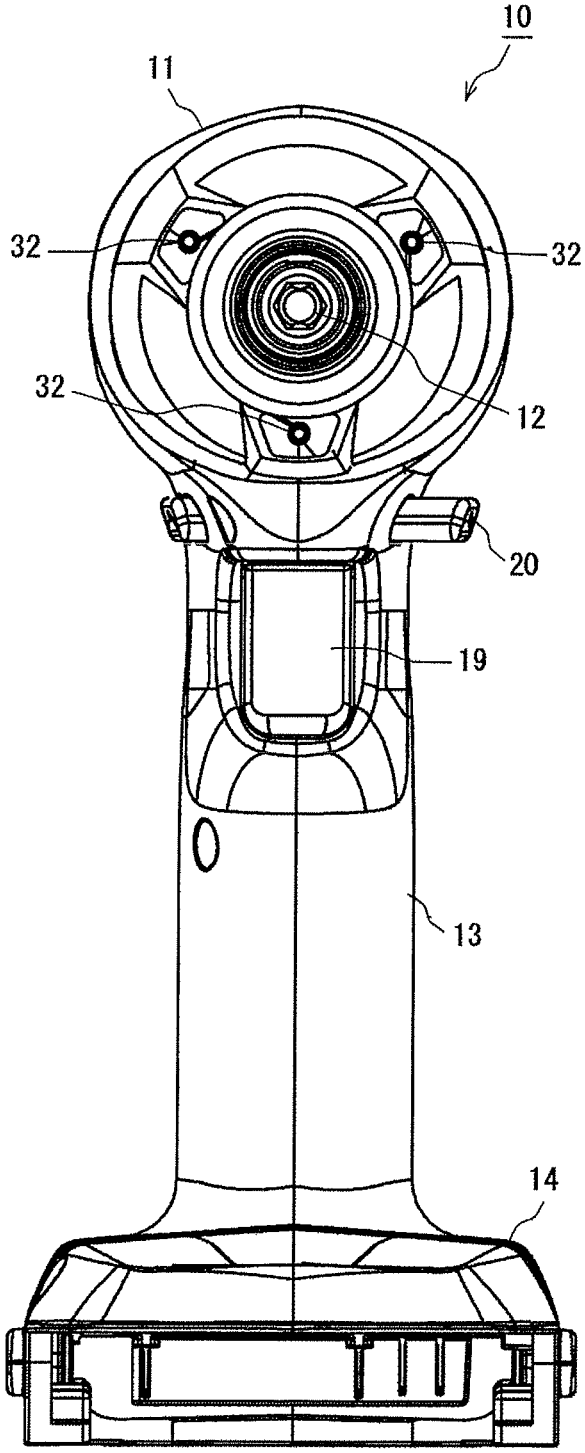
FIG. 3 is a front view of the rotary tool to illustrate a state in which a switching lever is operated in a forward rotation state.
Figure 4:
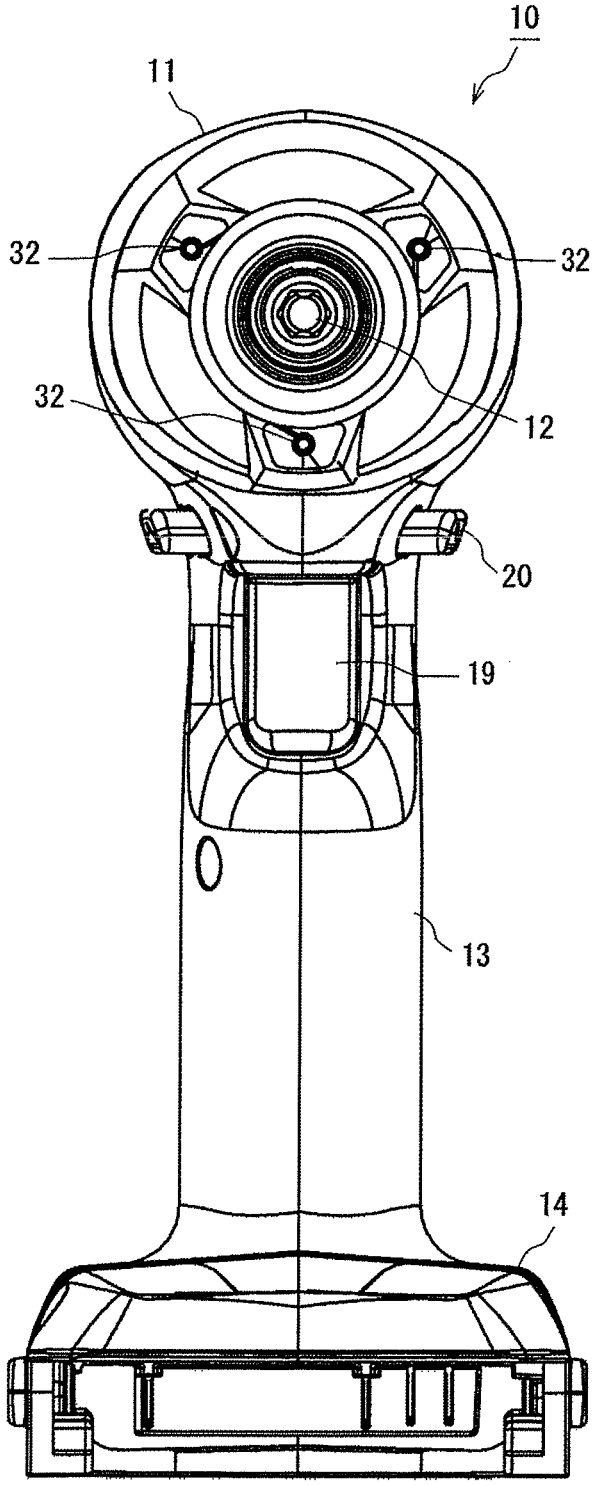
FIG. 4 is a front view of the rotary tool to illustrate a state in which the switching lever is operated in a neutral state.
Figure 5:
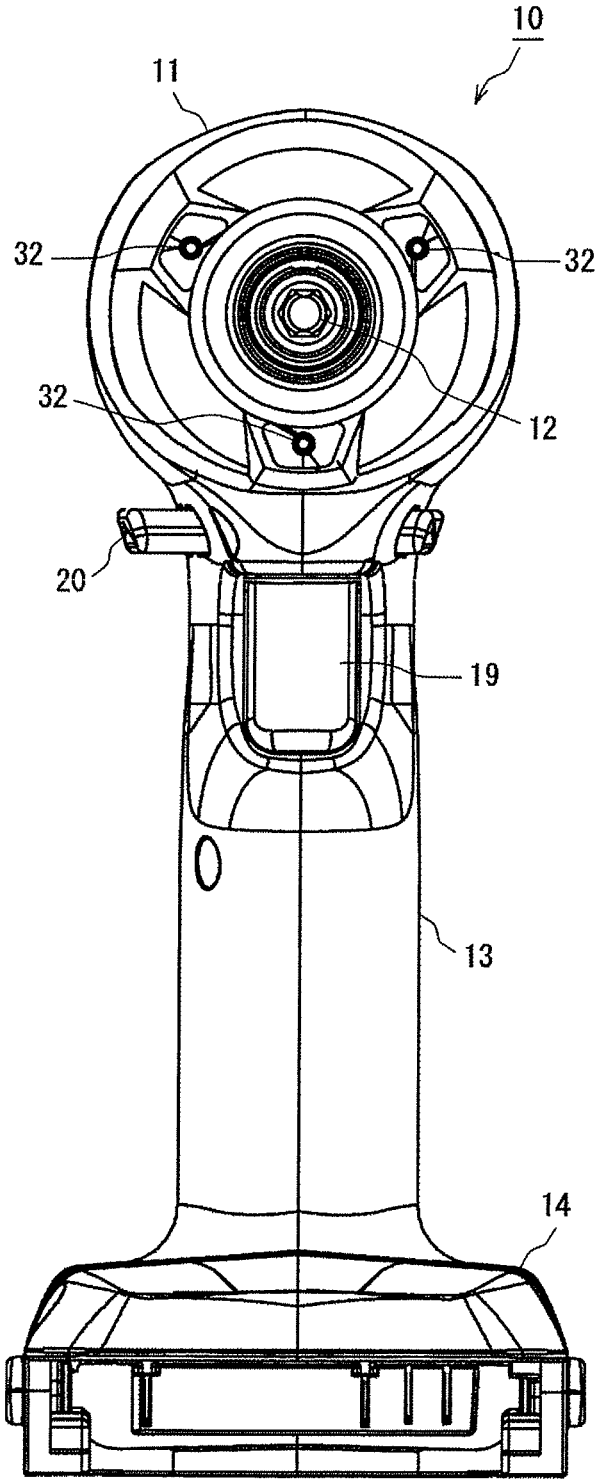
FIG. 5 is a front view of the rotary tool to illustrate a state in which the switching lever is operated in a reverse rotation state.

A plurality of LEDs 32 are installed around the output shaft 12, as illustrated in FIGS. 3 to 5, as an illumination unit 32 for illuminating a work place. When working at a dark work place, the illumination unit 32 is turned on to enable a user to work safely and reliably.

<Grip Portion 13>

The grip portion 13 is a portion for holding the rotary 10 by the user. A trigger 19 is disposed in a forward direction around a boundary between the output portion 11 and the grip portion 13, as illustrated in FIG. 1, and a switching lever 20 is disposed in a rearward direction.

The trigger 19 is adapted to operate the rotary tool 10. As the trigger 19 is pulled, a power source switch 21 or a rotation control switch 22 which will be described later is turned on, so that the rotary tool 10 starts to operate. The trigger 19 is disposed at a position where an index finger is caught when the user holds the grip portion 13.

The switching lever 20 is adapted to determine a rotational direction of the motor 31. As illustrated in FIGS. 3 to 5, the switching lever 20 is disposed so that left and right end portions protrudes from a lateral surface of the grip portion 13. The switching lever 20 is configured to be slid in a direction perpendicular to the output shaft 12 by pushing any one of the left and right end portions. The switching lever 20 is disposed at a position where it is operable by a thumb or index finger while the grip portion 13 is held.

In this embodiment, as illustrated in FIG. 3, the state, in which the left end portion of the switching lever 20 is pushed when seen from its front, is a forward rotation state to rotate forwardly the motor 31. If the trigger 19 is pulled in the forward rotation state, the motor 31 is forwardly rotated.

In this embodiment, as illustrated in FIG. 5, the state, in which the right end portion of the switching lever 20 is pushed when seen from its front, is a reverse rotation state to rotate reversely the motor 31. If the trigger 19 is pulled in the reverse rotation state, the motor 31 is reversely rotated.

Also, as illustrated in FIG. 4, the state, in which the switching lever 20 is positioned at an intermediate position when seen from its front, is a neutral state which is not any one of the forward rotation state and the reverse rotation state. The neutral state restricts so that the trigger 19 is not pulled, which will be described later.

<Battery Pack Fitting Section 14>

The battery pack fitting section 14 is a portion to which a battery pack (not illustrated) is attached to or detached from the bottom surface. An operation panel 15 is installed on an upper surface of the battery pack fitting section 14, as illustrated in FIG. 1. The operation panel 15 is provided with a mode display lamp 16 for displaying a current rotation mode, a mode setting button 17 for changing the rotation mode, and a light switching button 18 for setting illumination brightness of the illumination unit 32.

A control printed board which is connected to each button or lamp of the operation panel 15 is built in the battery pack fitting section 14 which is positioned at the rear side of the operation panel 15. A control device 100 (see FIG. 2) mounted on the control printed board is configured to control the operation of the rotary tool 10.

The control device 100 is configured on the basis of a CPU, which is not specifically illustrated, to process input of various switches or the like and control the driving of the motor 31 or the like.

Figure 2:
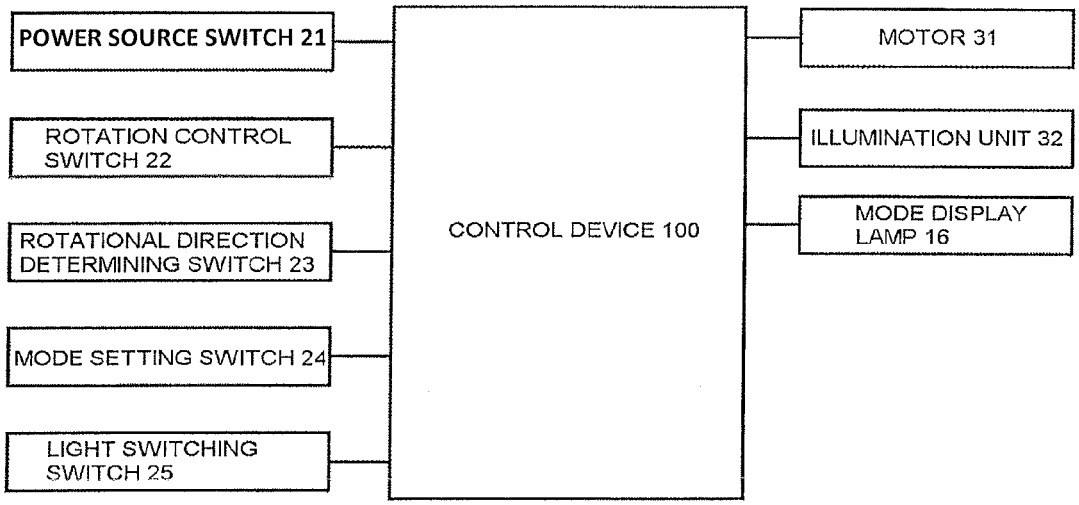
FIG. 2 is a block diagram illustrating an input/output of a control device built in the rotary tool.

The control device 100 is connected to the respective switches of the power source switch 21, the rotation control switch 22, a rotational direction determining switch 23, the mode setting switch 24, and the light switching switch 25, as illustrated in FIG. 2.

Next, the respective switches will be described.

<Power Source Switch 21>

The power source switch 21 is a switch to turn on a power source of the rotary tool 10 when the trigger 19 is pulled to a predetermined position. Specifically, as a contact point comes in when the trigger 19 is pulled by about ⅕ of the maximum pull amount, the power source switch is a switch which outputs a start signal for electrically connecting the power source. If the control device 100 receives the start signal, the power source switch 21 is returned from a sleep state, and executes the electrical connection of the motor 31 or the turn-on of the mode display lamp 16.

<Rotation Control Switch 22>

The rotation control switch 22 is a switch for rotating the motor 31 at the number of revolution which depends upon an amount of pulling of the trigger 19, and the control device 100 enables the motor 31 to rotate at the number of revolutions in accordance with the control signal, in a case where the control signal is a predetermined threshold value or more.

<Rotational Direction Determining Switch 23>

The rotational direction determining switch 23 is a switch for outputting a rotation direction signal to determine the rotation direction of the motor 31. The output of the rotational direction determining switch 23 is switched by the switching lever 20. As illustrated in FIG. 3, the rotational direction determining switch 23 is configured to select any one of three patterns, that is, to output a forward rotational signal, to output a reverse rotational signal, or not to output both forward rotational signal and reverse rotational signal. The control device 100 rotates the motor forwardly in the case where the trigger 19 is operated while the forward rotational signal is received, and rotates the motor reversely in the case where the trigger 19 is operated while the reverse rotational signal is received. Also, the control device 100 can detect the state in which the rotational direction determining switch 23 is at the neutral position, if both the forward rotational signal and the reverse rotational signal are not received.

<Mode Setting Switch 24>

The mode setting switch 24 is a switch for outputting the mode setting signal when the mode setting button 17 of the operation panel 15 is operated. If the control device 100 receives the mode setting signal, it rewrites a mode flag of internal status, and switches the display of the mode display lamp 16 in accordance with the rotation mode.

Figures 12, 13, 14:
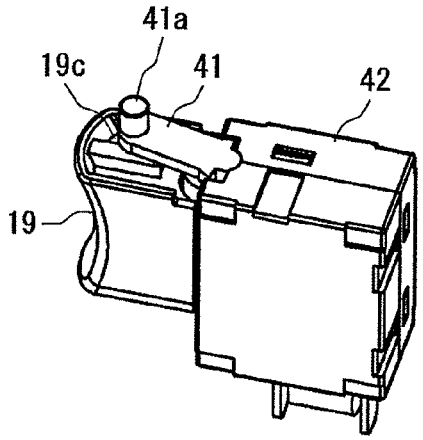
FIG. 12 is a diagram illustrating the relationship between the swivel member and the trigger, after the trigger is pulled in the state in which the switching lever is operated in the reverse rotation state.
FIG. 13 is a table illustrating kinds of signals output from a rotational direction determining switch.
FIG. 14 is a table illustrating a rotation mode of the rotational tool.

The rotary tool 10 according to this embodiment includes four rotation modes, that is, a 'strong (for steel)' mode, a 'strong (for wood)' mode, a 'weak' mode, and a 'retightening' mode, as illustrated in FIG. 14. The 'strong (for steel)' mode is a mode in which a screw fastening speed is regarded as important at the time of low-load work. The 'strong (for wood)' mode is a mode in which a bit is hard to release at the time of a high-load work. The 'weak' mode is a mode in which detailed fine adjustment such as a small screw is required. The 'retightening' mode is a mode in which a slightly loosed screw at the time of fixing a wallboard or the like is retightened (mode in which if the trigger 19 is pulled once, it is rotated by about ¼ after striking, and then the rotation is stopped).

As the internal processing, whenever one mode setting signal is received, the mode flag (see FIG. 14) is incremented by one at a time, and the mode is executed in order of 'strong (for steel)', 'strong (for wood)', 'weak', and 'retightening'. Also, if the mode setting signal is received in the 'retightening' mode, the mode flag is set as 0, and it is executed as the 'strong (for steel)' mode.

The rotation mode set as described above is referred by the control device 100 when the above-described control signal is outputted to rotate the motor 31.

<Light Switching Switch 25>

The light switching switch 25 is a switch for changing the illumination brightness of the illumination unit 32. Also, the light switching switch 25 is a switch for outputting the light switching signal when the light switching button 18 of the operation panel 15 is operated. If the control device 100 receives the light switching signal, the illumination brightness mode of the internal status is changed, and the illumination brightness of the illumination unit 32 is changed in accordance with the illumination brightness mode. For example, in the case where it includes a 'strong mode', an 'intermediate mode', and a 'weak mode' as the illumination brightness mode, the light switching switch 25 performs a process of sequentially changing the illumination brightness in order of 'strong', 'intermediate' and 'weak'.

<Regarding Relationship Between Switching Lever 20 and Trigger 19>

Next, the relationship between the switching lever 20 and the trigger 19 will be described.

Figure 6:
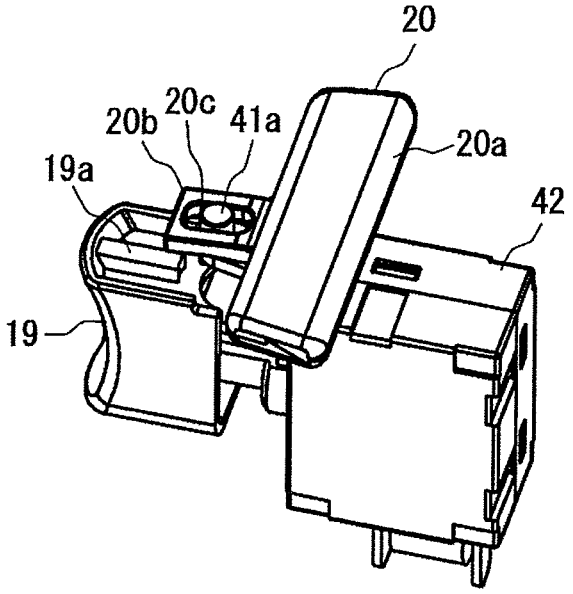
FIG. 6 is a diagram illustrating an internal mechanism around the switching lever.

FIG. 6 is a diagram illustrating an internal mechanism around the switching lever 20. As illustrated in FIG. 6, a box-shaped switch case 42 is installed in the grip portion 13. Although not specifically illustrated, the switch case 42 is provided with the respective switches of the power source switch 21, the rotation control switch 22, and the rotational direction determining switch 23.

The trigger 19 is slidably attached to the front of the switch case 42. As the trigger 19 is pulled, the trigger 19 comes in the switch case 42. The trigger 19 is constantly pressed in a direction protruding from the switch case 42. Also, the trigger 19 is connected to the power source switch 21 and the rotation control switch 22 in the switch case 42. For this reason, if the trigger is pulled, the power source switch 21 and the rotation control switch 22 in the switch case 42 are turned on.

A swivel member 41 is swivably attached to the upper portion of the trigger 19. A boss 41*a* protrudes upward from an end portion of the swivel member 41, and the switching lever 20 is installed to engage with the boss 41*a*.

The switching lever 20 includes an operation portion 20*a* protruding from the lateral portion of the grip portion 13 when the switching lever is accommodated in the grip portion 13, and an engaging portion 20*b* protruding forward to be perpendicular to a longitudinal direction of the operation portion 20*a*. The engaging portion 20*b* is provided with a slot 20*c* at a center thereof. As the boss 41*a* of the swivel member 41 is inserted in the slot 20*c*, the switching lever is engaged with the swivel member 41. In this way, when the switching lever 20 is slid in a left and right direction, the swivel member 41 is swiveled.

Although not specifically illustrated, the swivel member 41 is connected to the rotational direction determining switch 23 in the switch case 42. When the switching lever 20 is operated in the forward rotation state and the swivel member 41 is swiveled, the forward rotation signal is output to the rotational direction determining switch 23. When the switching lever 20 is operated in the reverse rotation state and the swivel member 41 is swiveled, the reverse rotation signal is output to the rotational direction determining switch 23. When the switching lever 20 is operated in the neutral state and the swivel member 41 is positioned at the center, both the forward rotation signal and the reverse rotation signal are not output to the rotational direction determining switch 23.

As illustrated in FIG. 6 and the like, the upper surface of the trigger 19 is provided with a restricting rib 19*a*. The restricting rib 19*a* protrudes in a stripe shape along a sliding movement direction of the trigger 19. In this way, both sides of the restricting rib 19*a* is provided with two forward rotation guide groove 19*b* and reverse rotation guide groove 19*c*.

Figure 7:
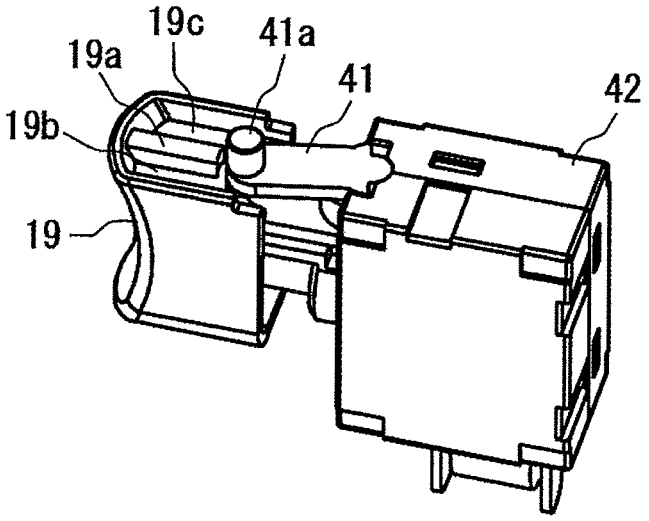
FIG. 7 is a diagram illustrating a relationship between a swivel member and a trigger, before the switching lever is operated in the forward rotation state.
Figure 8:
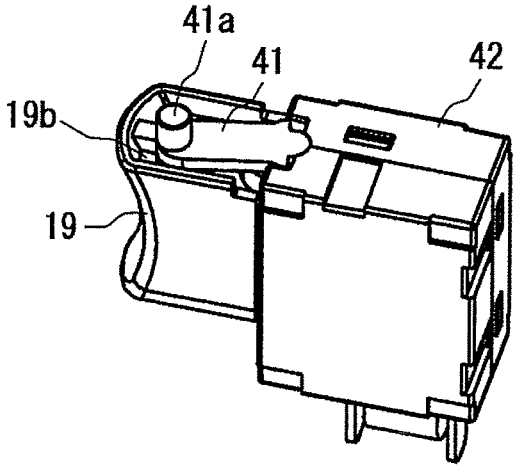
FIG. 8 is a diagram illustrating the relationship between the swivel member and the trigger, after the trigger is pulled in the state in which the switching lever is operated in the forward rotation state.

When the switching lever 20 is operated in the forward rotation state, the forward rotation guide groove 19*b* guides the sliding movement of the trigger 19. When the switching lever 20 is operated in the forward rotation state, as illustrated in FIGS. 7 and 8, since the front end of the swivel member 41 swivels in the forward rotation guide groove 19*b*, the front end of the swivel member 41 comes in the forward rotation guide groove 19*b*, so that the trigger 19 can be deeply pulled.

Figure 11:
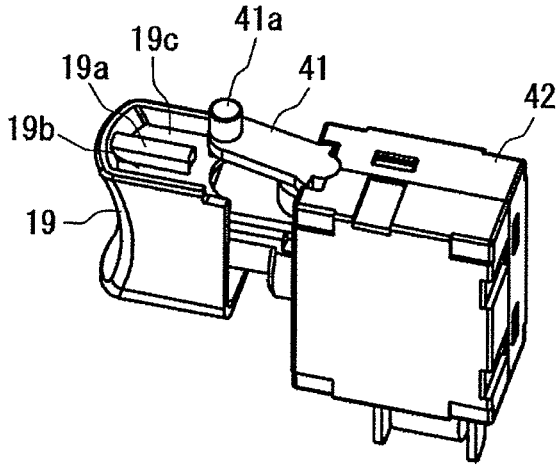
FIG. 11 is a diagram illustrating the relationship between the swivel member and the trigger, before the trigger is pulled in the state in which the switching lever is operated in the reverse rotation state.

When the switching lever 20 is operated in the reverse rotation state, the reverse rotation guide groove 19*c* guides the sliding movement of the trigger 19. When the switching lever 20 is operated in the reverse rotation state, as illustrated in FIGS. 11 and 12, since the front end of the swivel member 41 swivels in the reverse rotation guide groove 19*c*, the front end of the swivel member 41 comes in the reverse rotation guide groove 19*c*, so that the trigger 19 can be deeply pulled.

If the trigger 19 is pulled along the forward rotation guide groove 19*b* or the reverse rotation guide groove 19*c*, the power source switch 21 and the rotation control switch 22 are connected to the trigger 19 in the switch case 42 are turned on. Specifically, the power source switch 21 first outputs a start signal to start the energization of the motor 31 or the like. After that, the rotation control switch 22 outputs the control signal to start the rotation of the motor 31.

Figure 9:
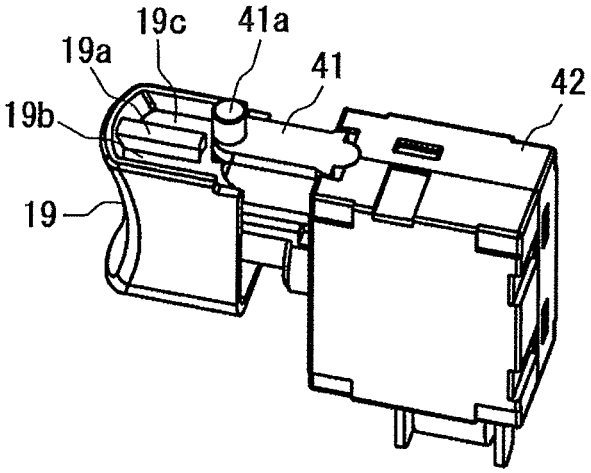
FIG. 9 is a diagram illustrating the relationship between the swivel member and the trigger, before the trigger is pulled in the state in which the switching lever is operated in the neutral state.
Figure 10:
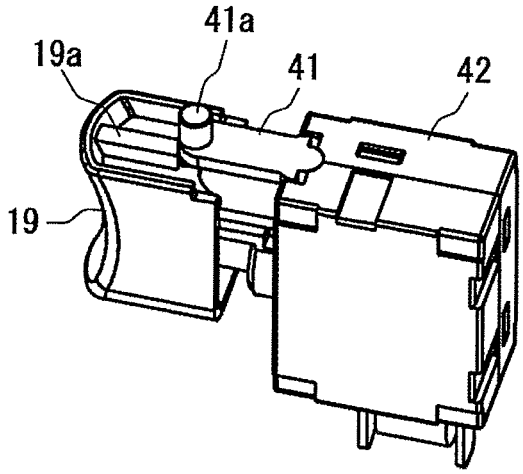
FIG. 10 is a diagram illustrating the relationship between the swivel member and the trigger, after the trigger is pulled in the state in which the switching lever is operated in the neutral state.

When the switching lever 20 is operated in the neutral state, as illustrated in FIGS. 9 and 10, since the front end of the swivel member 41 does not swivel, the front end of the swivel member 41 is disposed to face the restricting rib 19*a*. For this reason, when the switching lever 20 is operated in the neutral state, the trigger 19 can be pulled by a predetermined position (position illustrated in FIG. 10) where the front end of the swivel member 41 comes into contact with the restricting rib 19*a*.

When the trigger 19 is pulled by the predetermined position, the power source switch 21 outputs the start signal, but the rotation control switch 22 does not output the control signal (otherwise the rotation control switch outputs a control signal which is less than a threshold value required to start the rotation). For this reason, even though the trigger 19 is pulled to the maximum in the state in which the switching lever 20 is operated in the neutral state, the motor 31 does not start to rotate by only the output of the start signal.

That is, when the switching lever 20 is operated in the neutral state, the trigger 19 is restricted to be pulled more than the predetermined position. Therefore, when the mode is switched, the rotation of the motor 31 by the rotation control switch 22 is not carried out by the operation of the trigger 19, thereby switching the mode safely.

In this embodiment, in the case where the trigger 19 is pulled in the state in which the switching lever 20 is operated in the neutral state, and thus the start signal is output, the processing is carried out in which if the power source is off, the power source is turned on, or if the power source is on, the rotation mode is changed.

<Regarding Processing Flow>

Next, the processing flow of the rotary tool 10 according to this embodiment will be described.

<Main Processing>

First, the main processing of the rotary tool 10 will be described with reference to a flowchart of FIG. 15.

Figure 15:
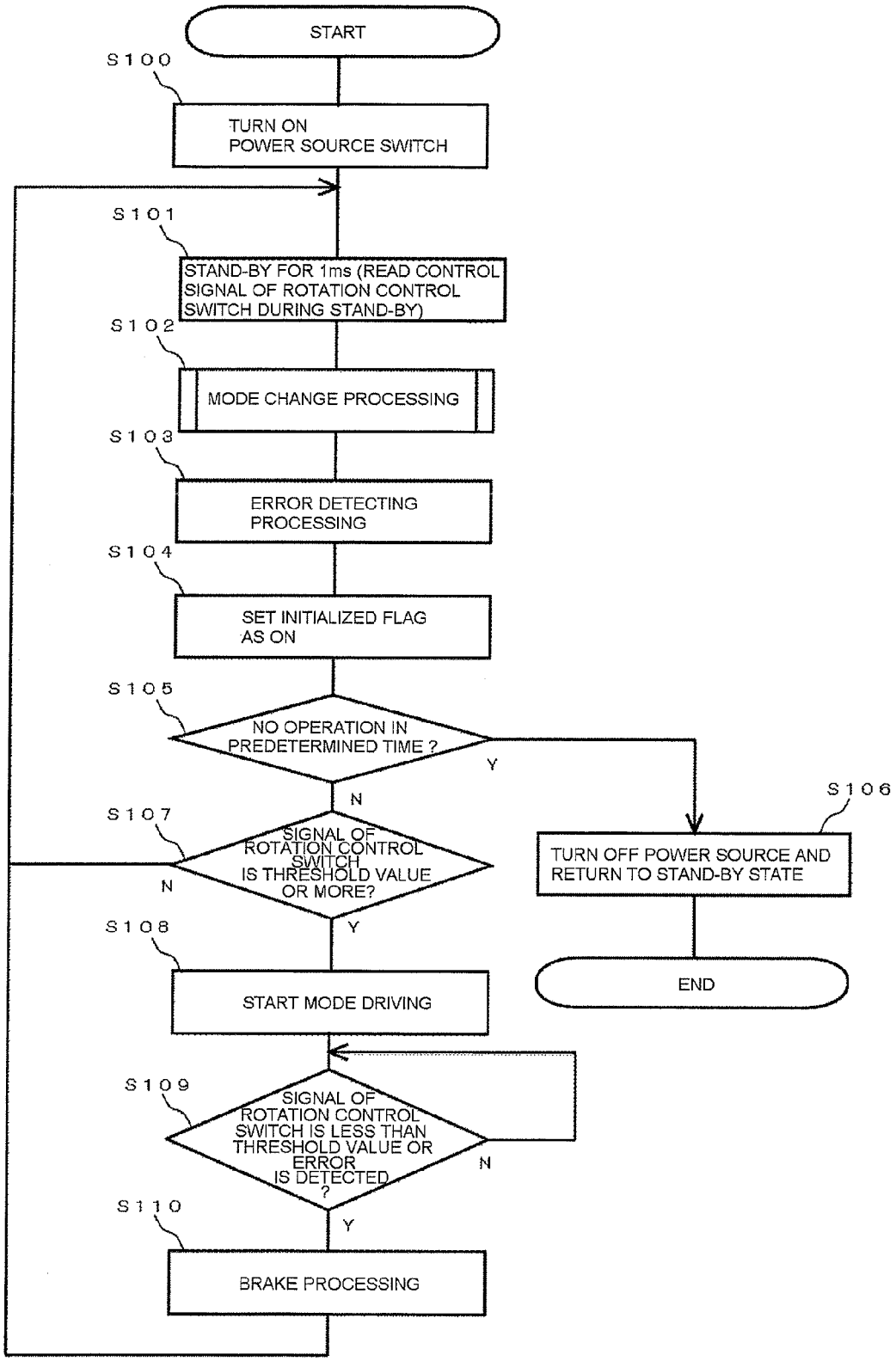
FIG. 15 is a flowchart illustrating a main processing of the rotational tool.

In step S100 illustrated in FIG. 15, as the trigger 19 is pulled by the predetermined position in the state in which the power source is off, the contact point of the power source switch 21 is turned on, and the start signal is output to the control device 100. As the control device 100 receives the start signal, the power source is turned on to execute the energization of the motor 31 or lighting of the mode display lamp 16.

In this instance, the flag, of which initialization is completed is reset as OFF, and a mode switch count is reset as 0. Also, since the mode flag is stored in a non-volatile memory, the previous rotation mode is restored, without being reset. And then, it proceeds to step S101.

In step S101, it stands by for 1 millisecond. The control device 100 reads the control signal of the rotation control switch 22 using the stand-by time. And then, it proceeds to step S102.

In step S102, a mode change processing which will be described later is executed. And then, it proceeds to step S103.

In step S103, an error detecting processing is executed. Specifically, it is determined whether an over-discharge error or abnormal voltage error occurs. And then, it proceeds to step S104.

In step S104, the flag of which the initialization is completed is set as ON. And then, it proceeds to step S105.

In step S105, it is determined whether a predetermined time operation is executed or not. If the predetermined time operation is not executed, it proceeds to step S106. If the operation is executed, it proceeds to step S107.

In the case where it proceeds to step S106, since the rotary tool 10 does not execute the predetermined time operation, the power source is turned off, and then it is held in a stand-by state. The processing is completed, and then it stands by until the power source switch 21 is turned on to turn the power source on.

In the case where it proceeds to step S107, it is determined whether the control signal of the rotation control switch 22 is the predetermined threshold value or more. If the control signal is less than the predetermined threshold value, it returns to step S101. In the case where the control signal is the predetermined threshold value or more, it proceeds to step S108.

In step S108, the motor 31 starts to drive. In this instance, driving control of the motor 31 is carried out with reference to the control signal read in step S101, the mode flag recorded in the non-volatile memory, and the forward rotation signal or reverse rotation signal output from the rotational direction determining switch 23. That is, the motor 31 starts to drive at the number of revolutions depending upon the size of the control signal, under the rotation control in accordance with the mode flag (rotation mode), and in the rotational direction in accordance with the forward rotation signal or reverse rotation signal. And then, it proceeds to step S109.

In step S109, the motor 31 drives continuously until the control signal of the rotation control switch 22 is less than the predetermined threshold value or the error is detected. In the case where the control signal of the rotation control switch 22 is less than the predetermined threshold value or the error is detected, it proceeds to step S110.

In step S110, a brake processing is executed to stop the motor 31. And then, it returns to step S101.

<Mode Change Processing>

The mode change processing according to this embodiment will now be described with reference to the flow in FIG. 16.

Figure 16:
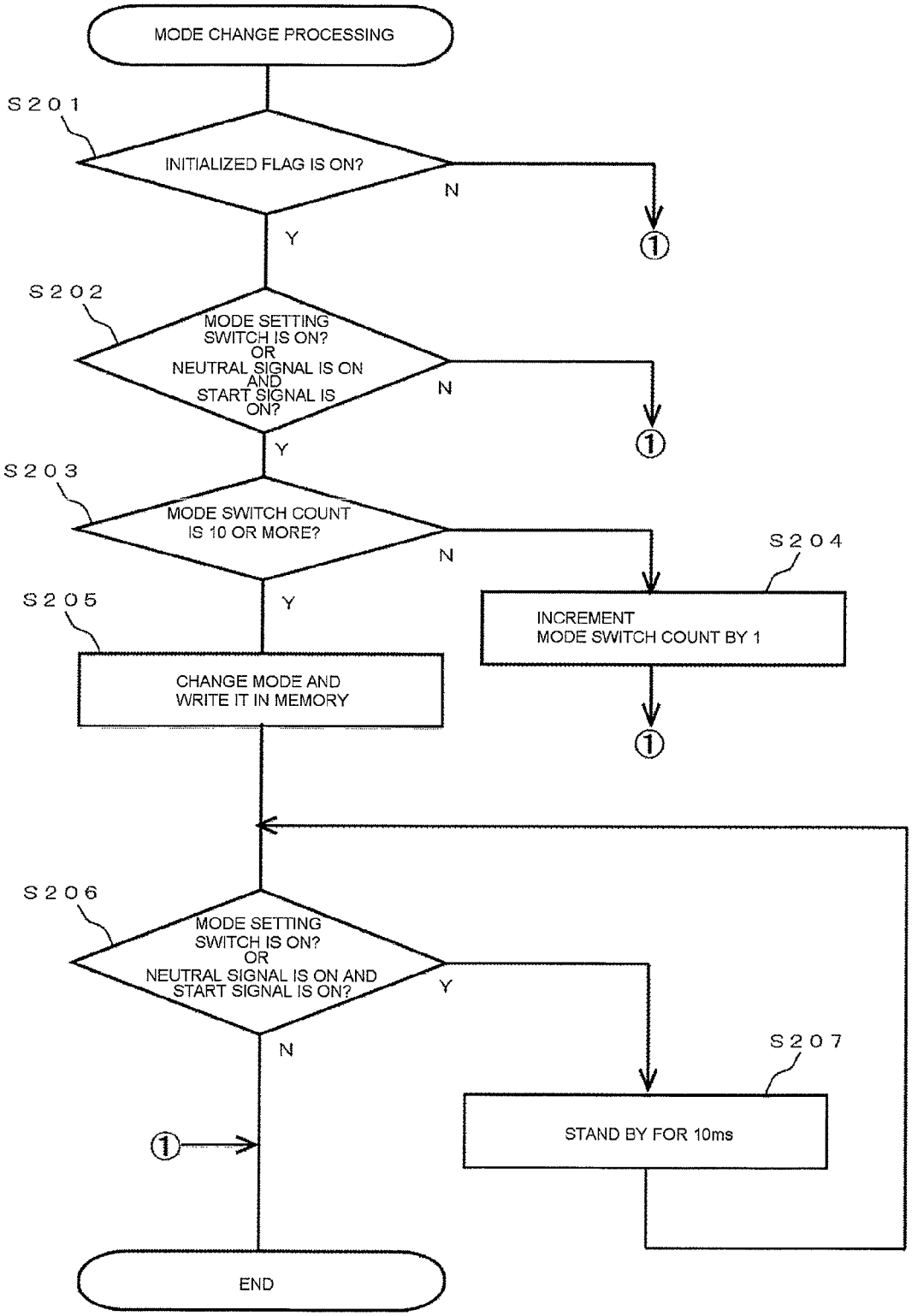
FIG. 16 is a flowchart illustrating a mode change processing of the rotational tool.

First, in step S201 illustrated in FIG. 16, it is determined whether the flag of which the initialization is completed is ON. If the flag of which the initialization is completed is ON, it proceeds to step S202. If the flag of which the initialization is completed is OFF, the processing is finished.

In step S202, it is checked the mode setting signal from the mode setting switch 24, the forward rotation signal or reverse rotation signal from the rotational direction determining switch 23, and the mode setting signal from the mode setting switch 24. If the mode setting signal is received, or in the case where it is detected the switching lever 20 is in the neutral state (neither the forward rotation signal nor the reverse rotation signal is received) and the start signal is received, it proceeds to step S203. For other cases, the processing is finished.

In step S203, it is determined whether the mode switch count is 10 or more. If the mode switch count is 10 or more, it proceeds to step S205. If the mode switch count is less than 10, it proceeds to step S204, and the mode switch count is incremented by 1, and then the processing is finished.

In step S205, the rotation mode is changed. Specifically, the value of the above-described mode flag is incremented by 1 (it is reset as 0 if the value of the mode flag is 3), and then is recorded in the non-volatile memory. In this instance, the display of the mode display lamp 16 is switched in correspondence to the new rotation mode. And then, it proceeds to step S206.

In step S206, it is checked the mode setting signal from the mode setting switch 24, the forward rotation signal or reverse rotation signal from the rotational direction determining switch 23, and the mode setting signal from the mode setting switch 24. If the mode setting signal is received, or in the case where it is detected the switching lever 20 is in the neutral state and the start signal is received, it proceeds to step S207. After it stands by for 10 milliseconds, and it again proceeds to step S206. For other cases, the processing is finished, since the signal which is a condition for the mode change is stopped.

According to the mode change processing, when the state satisfying any one of the following conditions (1) and (2) continues for a predetermined time (for example, 10 milliseconds), the rotation mode is changed.

(1) Receiving of the mode setting signal, and (2) Detecting the state in which the switching lever 20 is in the neutral state and receiving of the start signal.

That is, as well as pushing the mode setting button 17, the rotation mode can be changed even by pulling the trigger 19 in the state in which the switching lever 20 is in the neutral state.

Also, in the case where the trigger 19 is pulled in the state in which the power source is OFF, the flag of which the initialization is completed is OFF. The mode change processing is finished, which is a branch of step S201, and the rotation mode change is not executed. That is, only in the case where the trigger 19 is pulled in the state in which the power source is ON, the rotation mode change is executed.

As described above, according to this embodiment, when the switching lever 20 disposed around the grip portion 13 is operated in the neutral state, the trigger 19 is pulled to the predetermined position, and the signal is received from the power source switch 21, the switching of the rotation mode is executed. Therefore, the mode can be switched with the hand holding the grip portion 13.

Also, since the trigger 19 is restricted to be pulled more than the predetermined position when the switching lever 20 is operated in the neutral state, the rotation of the motor 31 by the rotation control switch 22 is not carried out by the operation of the trigger 19 at the time of the mode switching, thereby switching the mode safely.

In the above-described embodiment, although the rotation mode is changed by the operation of the trigger 19, the illumination brightness of the illumination unit 32 may be changed. That is, when the switching lever 20 disposed around the grip portion 13 is operated in the neutral state, the trigger 19 is pulled to the predetermined position, and the signal is received from the power source switch 21, the illumination brightness of the illumination unit 32 may be changed.

Also, in the above-described embodiment, when the switching lever 20 disposed around the grip portion 13 is operated in the neutral state, the trigger 19 is pulled to the predetermined position, and the signal is received from the power source switch 21, the mode switching is carried out. But, when the switching lever 20 disposed around the grip portion 13 is operated in the neutral state, the trigger 19 is pulled more than the predetermined position, and the signal is received from the rotation control switch 22, the mode switching may be carried out. In this instance, even though the signal is received from the rotation control switch 22 when the switching lever 20 is operated in the neutral state, it can be controlled so that the motor 31 does not rotate.

To deal with a case where the rotation mode is changed by mistake and thus the rotary tool malfunctions, a unit for locking (overriding) the mode change may be provided. For example, there may be provided a mode change execution selecting unit for selecting whether the mode change is executed or not.

For example, although the switching lever 20 is operated in any one of the forward rotation state, the reverse rotation state, and the neutral state in the above-described embodiment, two states may be provided as the neutral state. That is, the switching lever 20 may be operated in four steps of the forward rotation state, the reverse rotation state, a first neutral state, and a second neutral state, in which the mode change is performed in the case where the trigger 19 is pulled in the first neutral state, and the mode change is not performed in the case where the trigger 19 is pulled in the second neutral state (if the power source is OFF, only a process of turning the power source on is executed).

In accordance with embodiments and modifications, a rotary tool 10 having a plurality of switchable modes may include: a motor 31; a trigger 19; a power source switch 21 that turns on a power source of the rotary tool when the trigger 19 is pulled to a predetermined position; a rotation control switch 22 which rotates the motor 31 when the trigger 19 is pulled over the predetermined position; and a switching lever 20 disposed around a grip 13 to determine a rotational direction of the motor 31. The switching lever 20 may be operable between a forward rotation state of forwardly rotating the motor, a reverse rotation state of reversely rotating the motor, and a neutral state which is neither the forward rotation state nor the reverse rotation state. A switching of the modes may be executed when the switching lever is positioned in the neutral state and the trigger is pulled.

In the above structure, the switching of the modes may be executed, when the trigger 19 is pulled to the predetermined position in the neutral state of the switching lever 20 and a signal is generated on the power source switch 21. The switching of the modes may be executed, when the trigger 19 is pulled over the predetermined position in the neutral state of the switching lever 20 and a signal is generated on the rotation control switch 22.

According to this structure, when the switching lever disposed around the grip portion is operated in the neutral state, the trigger is pulled to the predetermined position, and the signal is received from the power source switch, the switching of the mode is executed, or when the switching lever is operated in the neutral state, the trigger is pulled more than the predetermined position, and the signal is received from the rotation control switch, the switching of the mode is executed. Therefore, the user can switch the mode with the hand holding the grip portion. That is, since the switching lever for determining the rotational direction of the motor is usually disposed around the grip portion, the switching lever and the trigger are provided with the function of switching the mode, so that the user can switch the mode with the hand holding the grip portion.

Also, a target of the mode switching may be the rotation mode of the motor.

In addition, the target of the mode switching may be an illumination condition of the illumination unit 32.

The rotary tool 10 may include a mode setting button 17. The trigger 19 may be disposed at a position to be operable by an index finger of a hand holding the grip 13. The switching lever 20 may be disposed at a position to be operable by a thumb or the index finger of the hand holding the grip portion 13. The switching of the modes may be executed not only by the pulling operation of the trigger 19 in the neutral state of the switching lever 20 but also by an operation of the mode setting button 17.

The motor 31 may rotate in a determined rotating direction and in a switched mode.

What is claimed is:

1. A rotary tool having a plurality of switchable modes, the rotary tool comprising:

a motor;

a trigger;

a power source switch that turns on a power source of the rotary tool when the trigger is pulled to a predetermined position;

a rotation control switch which rotates the motor when the trigger is pulled over the predetermined position; and a switching lever disposed around a grip to determine a rotational direction of the motor, wherein the switching lever is operated between a forward rotation state of forwardly rotating the motor, a reverse rotation state of reversely rotating the motor, and a neutral state which is neither the forward rotation state nor the reverse rotation state, and wherein a switching of the modes is executed when the switching lever is positioned in the neutral state and the trigger is pulled.

2. The rotary tool according to claim 1, wherein switching of the modes is executed:

when the trigger is pulled to the predetermined position in the neutral state of the switching lever and a signal is generated on the power source switch; or when the trigger is pulled over the predetermined position in the neutral state of the switching lever and a signal is generated on the rotation control switch.

3. The rotary tool according to claim 1, wherein a rotation mode of the motor is changed by switching the modes.

4. The rotary tool according to claim 1, further comprising an illumination unit that illuminates a driving position, wherein an illumination condition of the illumination unit is changed by switching the modes.

5. The rotary tool according to claim 1, further comprising a mode setting button, wherein the trigger is disposed at a position to be operable by an index finger of a hand holding the grip, wherein the switching lever is disposed at a position to be operable by a thumb or the index finger of the hand holding the grip portion, and wherein the switching of the modes is executed not only by the pulling operation of the trigger in the neutral state of the switching lever but also by an operation of the mode setting button.

6. The rotary Tool according to claim 5, wherein the motor rotates in a determined rotating direction and in a switched mode.

* * * * *